US012577799B2

(12) United States Patent
Hughes et al.

(10) Patent No.: US 12,577,799 B2
(45) Date of Patent: Mar. 17, 2026

(54) TANNING LEDGE STRUCTURE FOR A FIBERGLASS SWIMMING POOL

(71) Applicant: Thursday Pools, Fortville, IN (US)

(72) Inventors: Jason Hughes, Heathsville, VA (US); Edward Vondell, Fortville, IN (US); William Khamis, Fortville, IN (US)

(73) Assignee: Thursday Pools, Fortville, IN (US)

( * ) Notice: Subject to any disclaimer, the term of this patent is extended or adjusted under 35 U.S.C. 154(b) by 270 days.

(21) Appl. No.: 18/490,043

(22) Filed: Oct. 19, 2023

(65) Prior Publication Data

US 2025/0129627 A1 Apr. 24, 2025

(51) Int. Cl.
*E04H 4/14* (2006.01)

(52) U.S. Cl.
CPC ..... *E04H 4/14* (2013.01)

(58) Field of Classification Search
CPC .. E04H 4/14; E04H 2004/0068; E04H 4/0037
USPC ..... 4/513, 506, 494
See application file for complete search history.

(56) References Cited

U.S. PATENT DOCUMENTS 3,114,153 A * 12/1963 Pierson ..... E04H 9/12 114/202
3,208,084 A * 9/1965 Collins ..... E04H 4/0037 428/116
3,720,964 A * 3/1973 Thomson ..... E04H 4/00 4/510
3,938,199 A * 2/1976 Laven ..... E04H 4/0043 4/510
4,146,937 A * 4/1979 Baker ..... E04H 4/1227 405/96
4,271,542 A * 6/1981 Wood ..... E04H 4/065 4/494
5,790,990 A * 8/1998 Hall ..... E04H 4/144 4/488
6,381,768 B1 * 5/2002 Herman ..... E04H 4/0037 4/541.1

(Continued)

FOREIGN PATENT DOCUMENTS

AU 2019210568 A1 * 1/2020 ..... E04H 4/12
CA 2723321 A1 * 6/2011 ..... E04H 4/0031

(Continued)

*Primary Examiner* — Lori L Baker
(74) *Attorney, Agent, or Firm* — David E. Novak; Brannon Sowers & Cracraft PC

(57) ABSTRACT

A swimming pool assembly, including a swimming pool body defining a pool top edge and an oppositely disposed bottom pool floor member connected by at least one pool wall and having a shallow tanning deck portion and a support structure for providing support to the deck portion operationally connected to the deck portion and extending away from the pool top edge. The support structure further includes a plurality of spaced elongated beam members, a support member operationally connected to the deck portion and to the plurality of spaced elongated beam members, wherein the respective spaced elongated beam members are positioned opposite the deck portion, at least one support structure wall member operationally connected to the plurality of spaced elongated beam members, and at least on pipeline operationally connected to the at least one support structure wall member and in hydraulic communication with at least one trough.

11 Claims, 7 Drawing Sheets

(56) References Cited

U.S. PATENT DOCUMENTS

| | | | | |
|---|---|---|---|---|
| D851,781 | S * | 6/2019 | Khamis | D25/2 |
| 11,680,420 | B1 * | 6/2023 | Barnes | E04H 4/14 4/496 |
| 2008/0134426 | A1 * | 6/2008 | Cronise | E04H 4/0031 4/506 |
| 2013/0014321 | A1 * | 1/2013 | Sullivan | E04H 4/0075 4/506 |
| 2015/0089732 | A1 * | 4/2015 | Khamis | H04L 45/14 405/302.7 |
| 2017/0167153 | A1 * | 6/2017 | Paull | E04H 4/0037 |
| 2018/0258662 | A1 * | 9/2018 | Khamis | E04H 4/0037 |
| 2019/0128003 | A1 * | 5/2019 | Khamis | E02D 27/32 |
| 2019/0136561 | A1 * | 5/2019 | Khamis | E04H 4/0037 |
| 2019/0169867 | A1 * | 6/2019 | Khamis | E04H 4/0018 |
| 2019/0169870 | A1 * | 6/2019 | Khamis | E04H 4/0018 |
| 2023/0097825 | A1 * | 3/2023 | Richards | E04H 4/0037 4/506 |

FOREIGN PATENT DOCUMENTS

| | | | | | |
|---|---|---|---|---|---|
| CA | 3042190 | A1 * | 11/2019 | | E04H 4/0043 |
| CN | 105019689 | A * | 11/2015 | | E04H 4/0056 |
| CN | 207499528 | U * | 6/2018 | | E04H 4/0043 |
| CN | 111395818 | A * | 7/2020 | | E04H 4/0043 |
| CN | 212428227 | U * | 1/2021 | | E04H 4/0043 |
| CN | 222667760 | U * | 3/2025 | | E04H 4/0043 |
| EP | 4155485 | A1 * | 3/2023 | | E04H 4/0031 |
| WO | WO-2020034006 | A1 * | 2/2020 | | E04H 4/0031 |

* cited by examiner

TANNING LEDGE STRUCTURE FOR A FIBERGLASS SWIMMING POOL

TECHNICAL FIELD

The present novel technology relates generally to the field of excavation, and, more particularly, to a method and apparatus for the stabilization and support of in-ground fiberglass pool bodies having preformed tanning ledges.

BACKGROUND

Preformed fiberglass swimming pools offer many advantages over vinyl liner and in-situ formed shotcrete or concrete walled swimming pools. Fiberglass pool bodies may be quickly and inexpensively formed and require considerably less effort to put into the ground. Recently, there has been increased interest in fiberglass pool bodies having a preformed shallow flat portion, such as a tanning ledge or tanning deck, upon which swimmers may lay for sun-tanning purposes. Fiberglass pools with large integrated tanning ledges and separate fiberglass tanning ledge units are growing in popularity because they provide a shallow area for bathers to relax, play, and sunbathe while still enjoying the water. However, installing fiberglass pools with integrated tanning ledges and separate fiberglass tanning ledges has presented challenges for both installers and pool owners when following currently accepted installation practices. Upon installation, the tanning ledge effectively becomes an overhang extending away from the main pool body, defining a crawlspace that must be backfilled to provide support for the tanning ledge. The backfill material is typically gravel, and backfilling is typically performed by one or more workmen crammed into the crawlspace to manually direct and distribute the gravel. Gravel backfill is preferred as it is less prone to flowing and settling, but is harder to evenly distribute under the tanning ledge and requires manual distribution by workmen. Backfilling with concrete removes the need for a workman, but is very costly. Further, backfilling the space with any material, such as gravel, sand, concrete or the like typically leaves a significant top void which results in the tanning ledge being unsupported, especially after the pool seasons and settles, leading to flexure and sagging of the tanning ledge. And, while less prone to flowing and settling, gravel backfill still experiences a non-negligible amount of the same, especially over time.

One of the biggest challenges in installing a tanning pool with a built-in tanning ledge is supporting the tanning ledge in such a way that it feels solid under foot. There are currently two predominant methods to accomplish this, either packing the void beneath the tanning ledge with stone or filling the void with flowable concrete. Both of these methodologies have led to common customer complaints such as the ledge floor not feeling solid, having distinguishable hollow spots or voids beneath the ledge, humps and valleys in the floor of the ledge, and the waterline not being level resulting from flowable concrete lifting a section of the vessel. These installation methods also present operational challenges for installers. Packing stone beneath tanning ledges is arduous and labor intensive and scheduling, purchasing, and placing flowable concrete under the ledge drives up costs and presents logistical challenges. Both methods add substantial hours or even days to a typical installation.

Thus, there remains a need for a method and apparatus that would allow easy installation of the pool body with proper support of the tanning ledge and haptic feedback to the swimmers. The present novel technology addresses this need.

SUMMARY

The present novel technology relates to a method and apparatus for providing a built-in support and reinforcement system positioned under the tanning ledge of a fiberglass swimming pool. One object of the present novel technology is to provide an improved fiberglass swimming pool system. Related objects and advantages of the present novel technology will be apparent from the following description.

DETAILED DESCRIPTION OF THE PREFERRED EMBODIMENT

Figure 1:
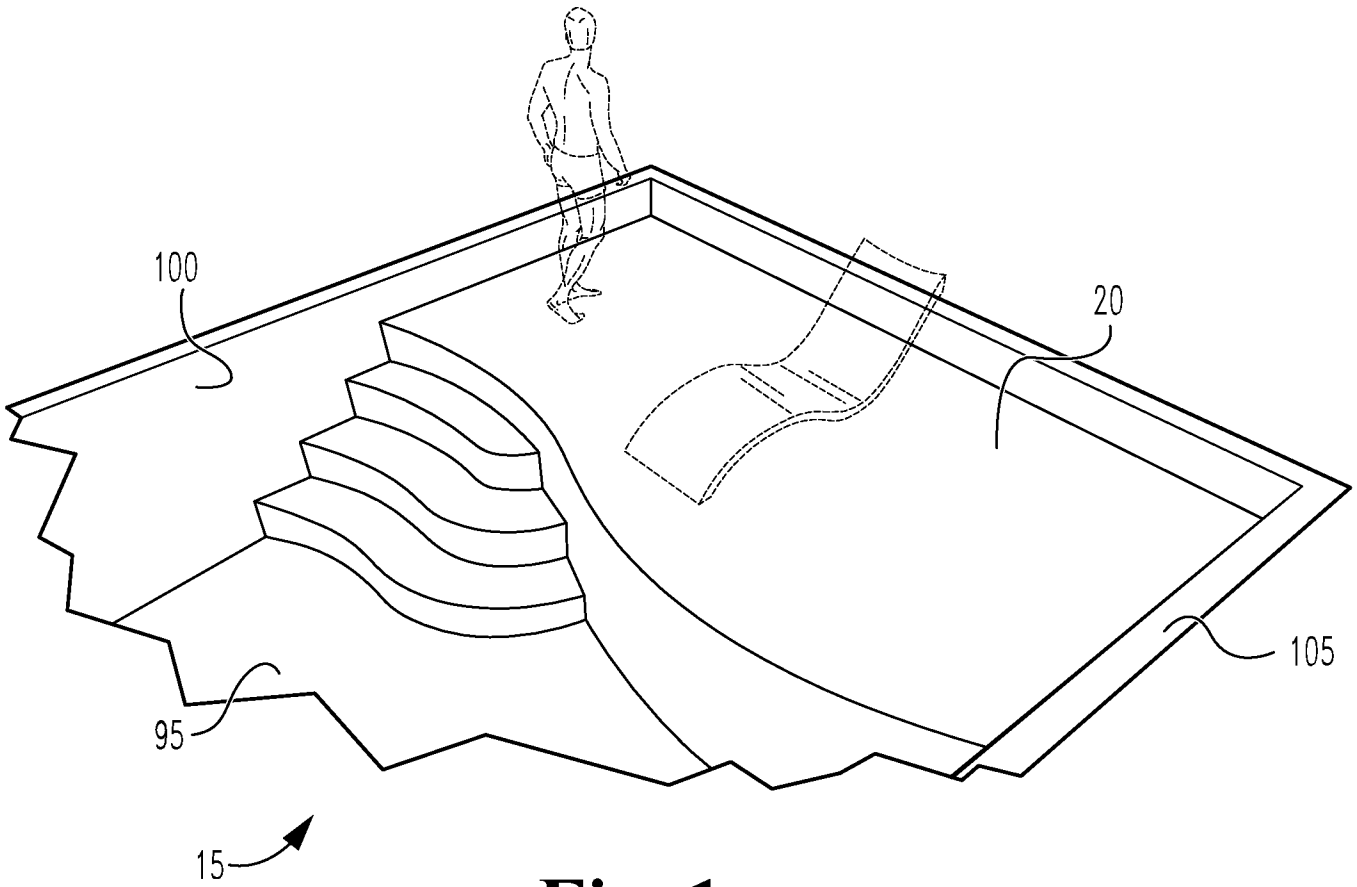
FIG. 1 is a side partial perspective view of a fiberglass pool assembly having a tanning ledge.
Figure 2:
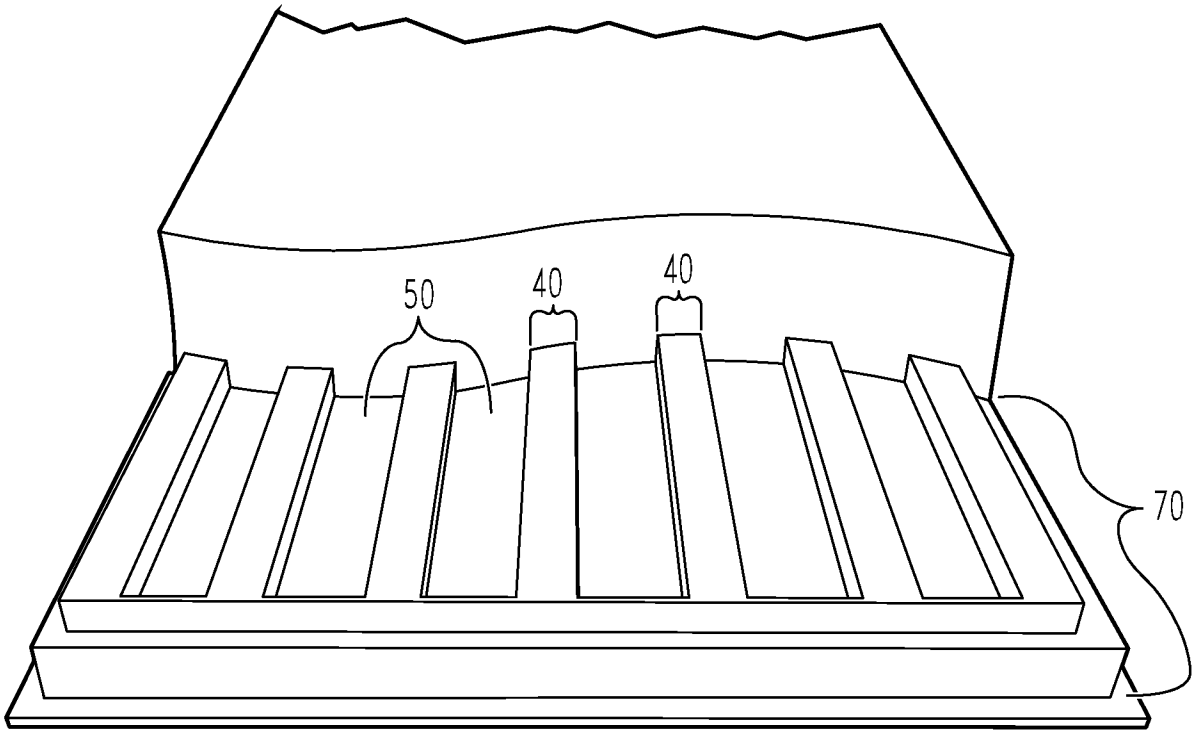
FIG. 2 is a first partial bottom perspective view of the pool assembly of FIG. 1 and showing of the present novel technology support assembly.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The present novel technology relates to an assembly 10 for assisting in the mounting or installing a fiberglass or like preformed swimming pool body 15 having a protruding or extending shallow tanning ledge or deck portion 20 into a freshly dug excavation 23, and includes a support structure 25 extending from the deck portion 20 into the excavation 23 for providing support for the deck portion 20 when the pool body 15 is installed in an excavation 23. The support structure 25 includes a plurality of spaced, elongated beams 30 extending therefrom. The respective beams 30 are typically hollow, typically made of fiberglass, and typically have square or rectangular cross-sectional shapes 35 defining flat bottoms 40 for engaging backfill 45 in the excavation 23. However, in some embodiments, the beams 30 may have other cross-sectional shapes, such as circular or semi-circular, ovoid, wedge, or the like, for custom engagement of the underlying backfill 45; in some embodiments, the beams 30 are solid; and in some embodiments the beams are made of other structural materials, such as plastic, aluminum, carbon-fiber or other composite materials, and the like.

The spaced beams 30 further define recessed troughs or voids 50 extending therebetween. The beams are typically oriented parallel to one another and thus define a plurality of parallel troughs 50 therebetween. However, in some embodiments, the beams 30 are non-parallel, and in other embodiments the beams 30 intersect one another defining a pattern or array of recesses or voids 50 therebetween.

Pipes or plumbing lines 55 are positioned to extend into at least some of the troughs 50 for supplying water to the pool 15 and/or for removal of accumulated water thereunder. The pipeline(s) 55 are typically operationally connected in hydraulic communication with at least one pump 60 for flowing standing water from below the tanning deck portion 20 to a sewer or reservoir 65 and/or for flowing water into the pool body 15, such as through jets, bubblers, and the like.

Figure 3:
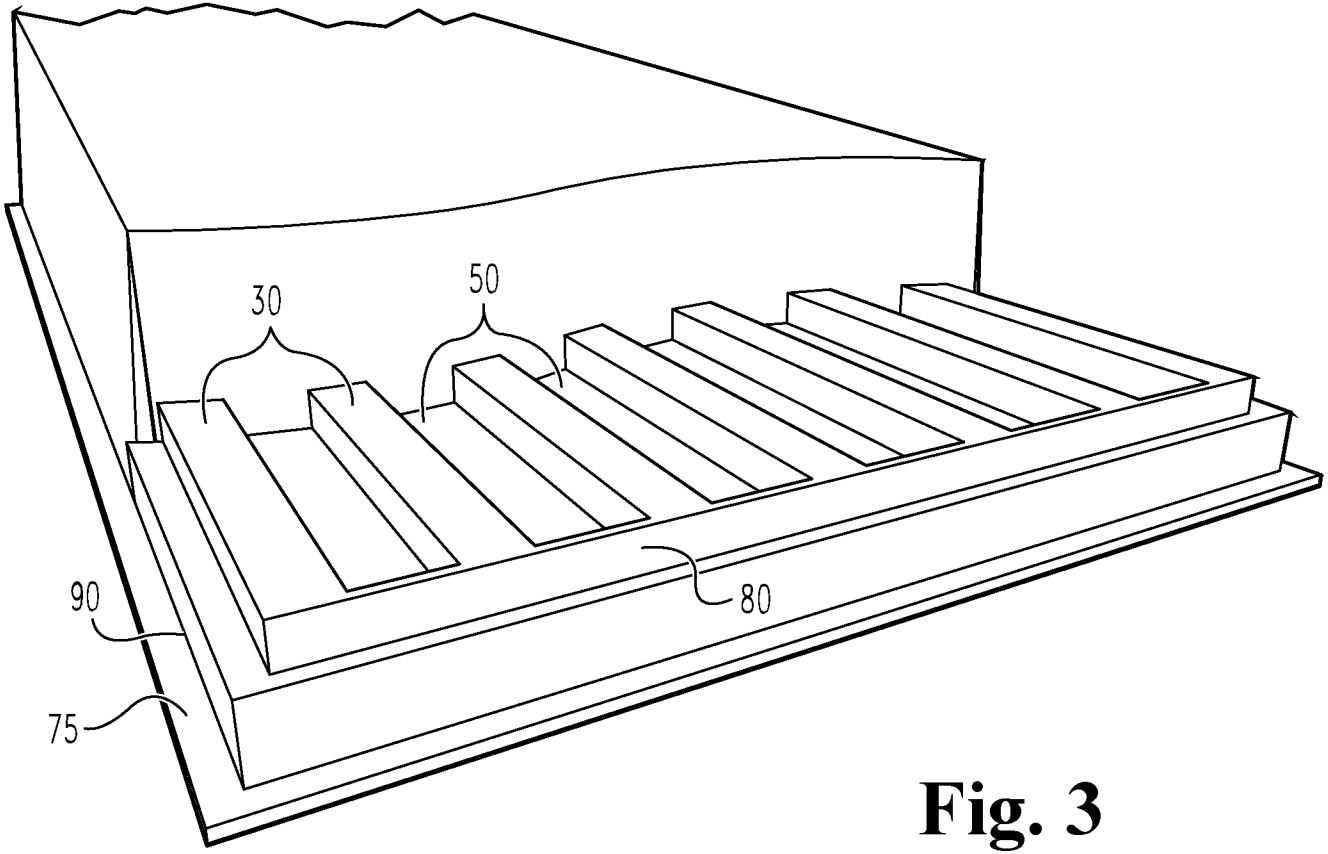
FIG. 3 is a second partial bottom perspective partial cutaway view of the curtain of FIG. 2.
Figure 4:
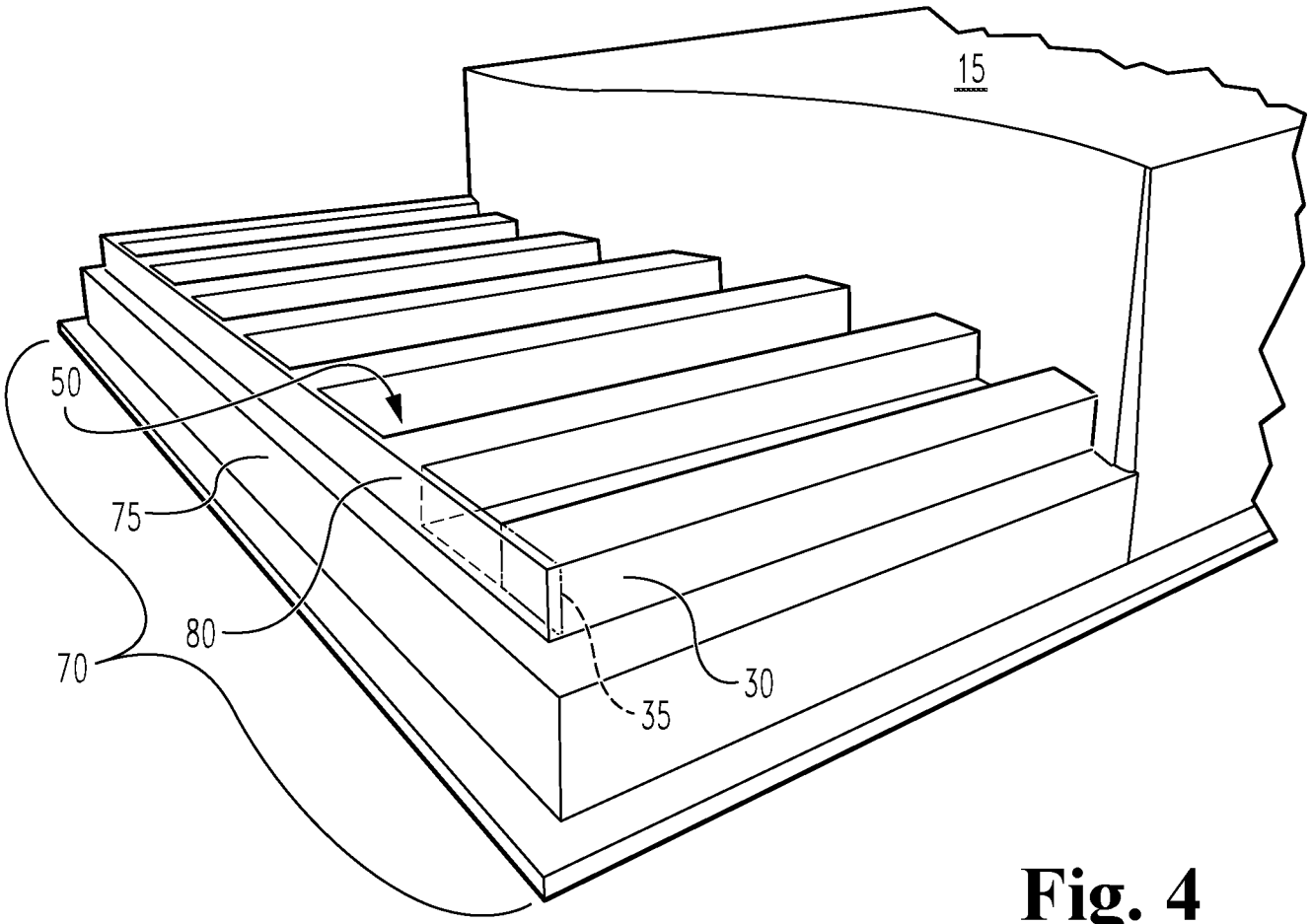
FIG. 4 is a third partial bottom perspective partial cutaway view of the curtain of FIG. 2.
Figure 5:
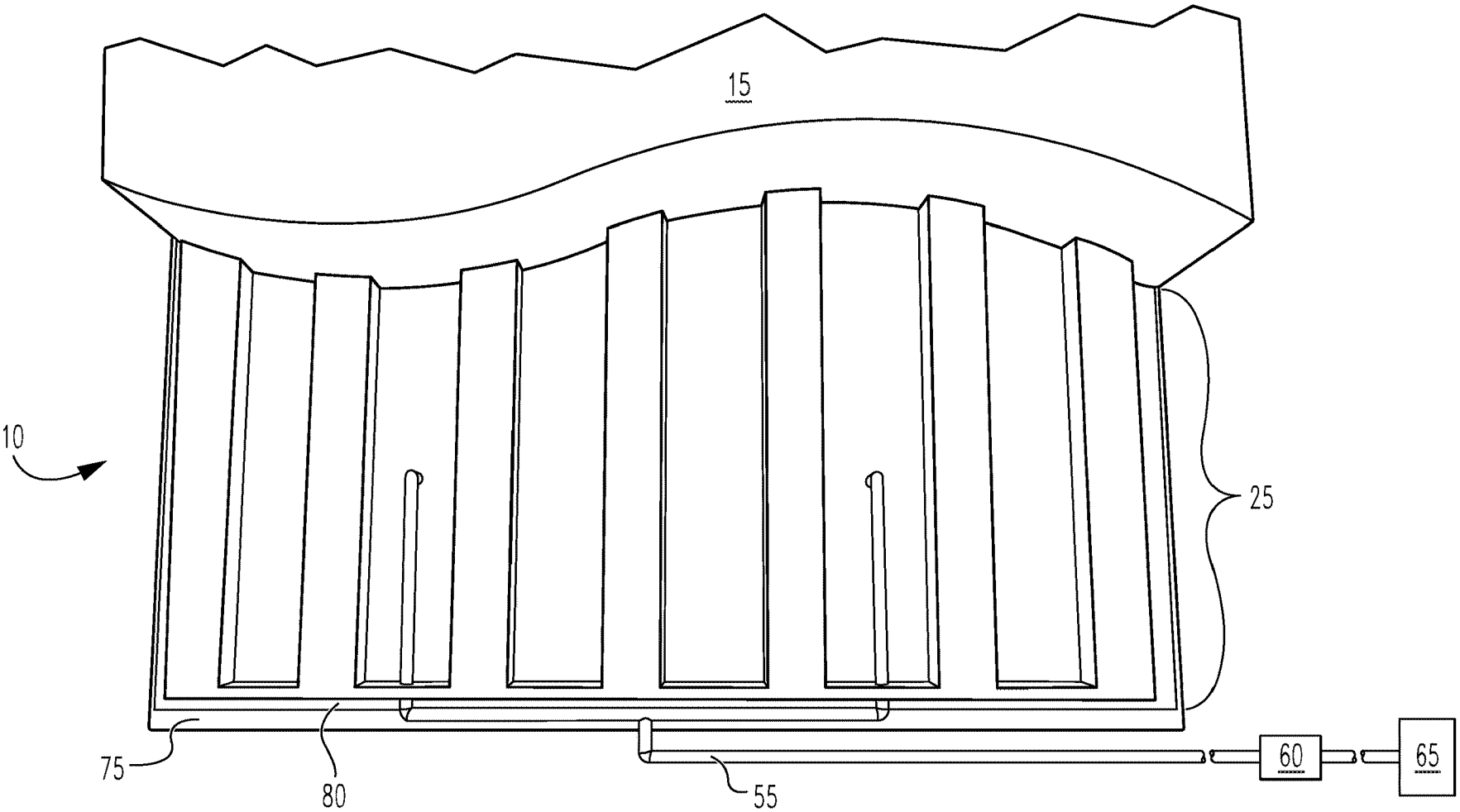
FIG. 5 is a partial bottom plan view of the pool assembly of FIG. 2 with the plumbing members engaged therewith.
Figure 6:
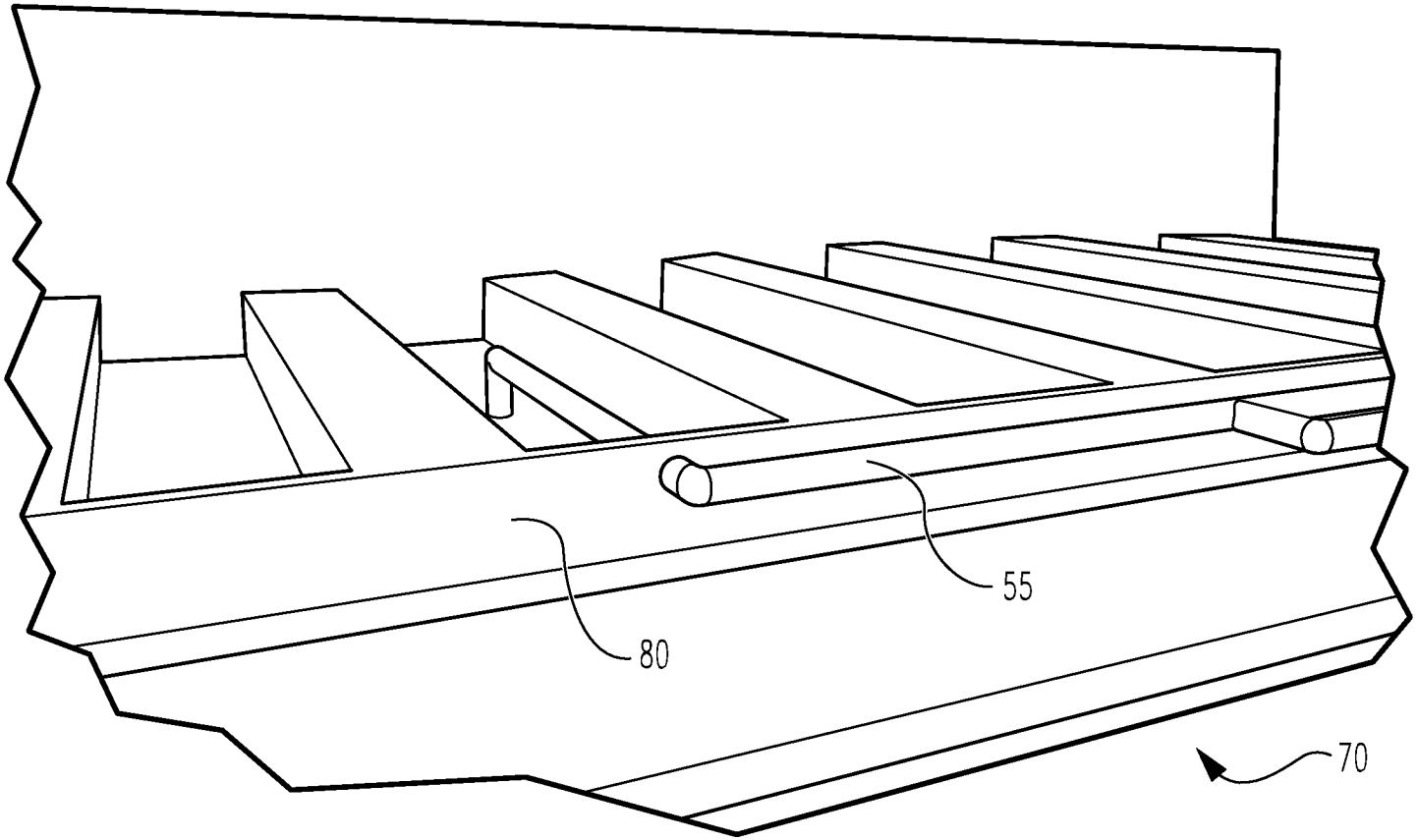
FIG. 6 is a partial bottom perspective view of the pool assembly of FIG. 2 with the plumbing members engaged therewith.
Figure 7:
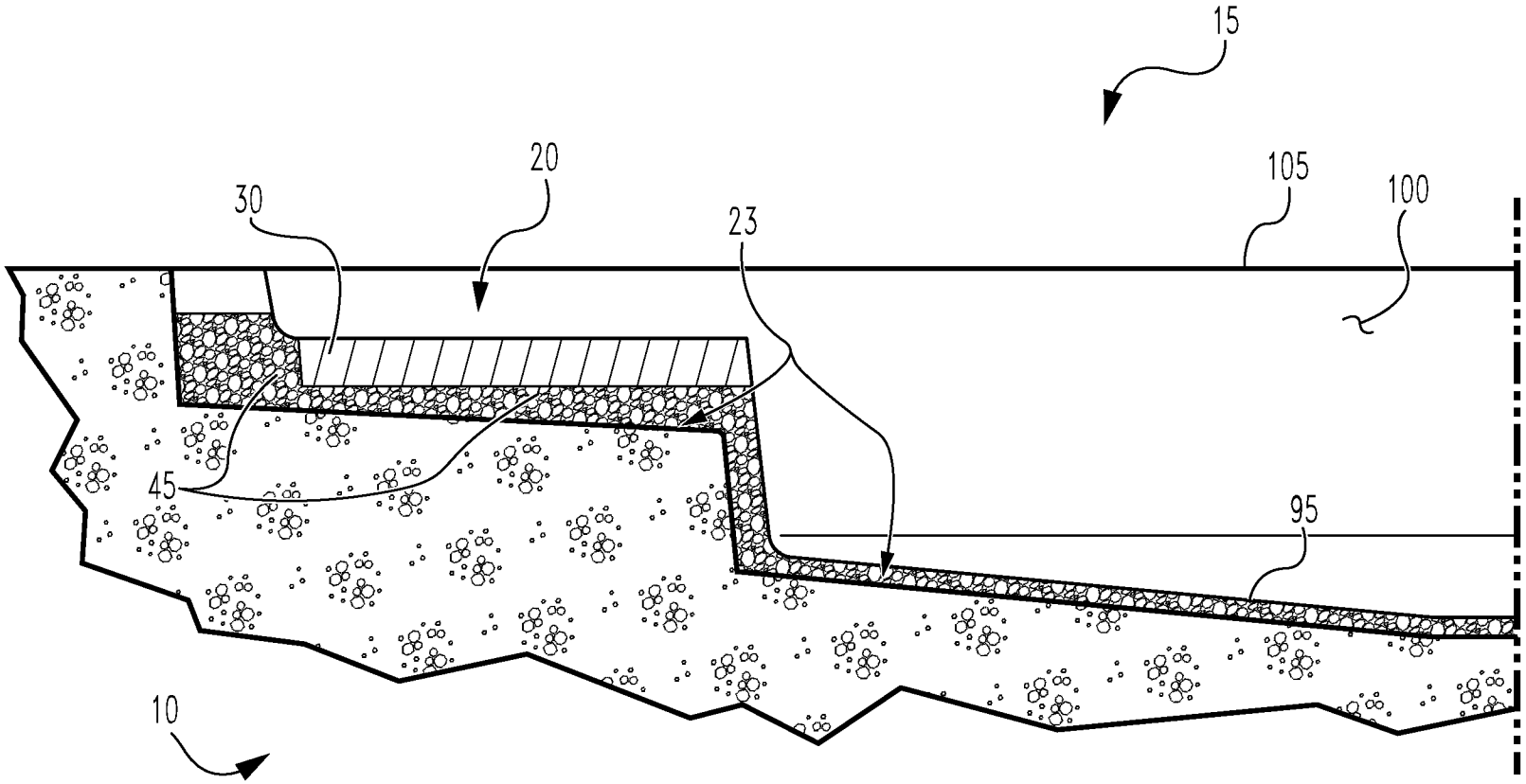
FIG. 7 is a side schematic view of the pool assembly of FIG. 2 with the support structure engaged to the fiberglass pool body and emplaced in the ground.

The typically hollow beams 30 may be formed as part of the unitary pool body 15, or may be formed separately and adhered to the undercarriage of the tanning ledge portion 20, such as by glue, lamination, fusion bonding 90, or the like. When formed separately, the beams 30 are typically made of typically made of a lightweight structural material, such as fiberglass, cardboard, composite materials, aluminum, foamed materials, concrete and like forms, and/or the like. Typically, the plurality of separately formed beams 30 are provided as part of an undercarriage assembly 70 that includes a plurality of beams 30, a plurality of troughs 50, a support member 75 for connecting to the pool body 15, and a support member 80 for engaging and accepting the plumbing lines 55. In some embodiments, support members 75, 80 are separate while in other embodiments support members 75, 80 are unitary. In the example of FIG. 3, support member 75 is the outer wall of the tanning ledge and/or the pool lip, while support member 80 doubles as a wall for preventing backfill material from spilling into the troughs; support members may be of any convenient structural material, such as fiberglass, fiberglass composite, carbon fiber composite, metal, or the like.

In operation, the plurality of beams 30 and/or the support structure 70 is/are typically installed when the pool 15 is produced or as an after-market upgrade, or may even be formed as a unitary part of the fiberglass pool body 15 during manufacture. Typically, the undercarriage assembly 70 is adhered to the pool body 15 under the tanning deck 20 by fiberglass fusion bonds 90 or like adhesive materials prior to the pool body 15 being emplaced in an excavation 23, so that the pool body 15 may be level and feel rigid and solidly supported when a person walks onto the tanning ledge 20. Typically, the pool body 15 has a bottom member or floor 95 and at least one pool wall 100 extending from the floor member 95 to the top lip 105; the pool body bottom member 95 and undercarriage assembly 70 typically extend equidistantly from the top lip 105 to make excavation simpler. However, the excavation 23 may be formed to approximate the shape of the pool body 15, including the shallow tanning ledge 20, and in such cases the bottom portions 95, 70 are positioned at different distances from the top lip 105 (or, in other words, the support structure 75 is shorter as the tanning ledge or sun deck 20 is shorter). The undercarriage assembly 70 thus reduces the amount of backfill material necessary to install the pool body 15 while providing structural support beneath the tanning ledge 20 to support the weight of water and/or swimmers. The troughs 50 also allow for installers to have better access to drill holes for water features, such as water jets, bubblers, LED lighting, and the like.

This process may define a method of stabilizing the tanning deck 20 of a preformed swimming pool body 15, including bonding a support structure member 30 and/or undercarriage assembly 70 to the pool body 15 beneath or adjacent the tanning deck portion 20, integrating plumbing members 55 thereinto, and then shoring up the volume of backfill material 45. The support structure assembly 10 may be provided as a kit for upgrading a fiberglass swimming pool body 15, and may include a supply of adhesive or bonding agent 90, an undercarriage assembly 70, support members 75, 80, plumbing members 55, and/or a plurality of beams 30.

The pool body 15 may be of any convenient shape, including rectangular, generally rectangular, kidney shaped, round, oval, or the like.

To summarize, the assembly 10 is typically a factory installed structural addition to the bottom 95 of a fiberglass pool tanning ledge 20 that resolves a number of common pool installation and maintenance challenges. The assembly 10 typically includes a plurality of hollow fiberglass beams 30 that are laminated or otherwise fused 90 to the bottom of the tanning ledge portion 20 of the pool vessel 15 and are spaced apart to allow channels 50 and plumbing 55 to be established beneath the ledge 20. The structural beams 30 are typically flat 40 on the bottom and allow the ledge 20 to be emplaced on a graded stone bed 45 or the like. The structural integrity of the assembly 10 produces a flat and level ledge floor that feels solid under foot and simplifies the process of leveling the entire vessel 15. Because the fiberglass beams 30 act top solidify the ledge 20, there is no need to fill the air space inside or between the beams 30 with material, thus eliminating the need to pack stone or place flowable concrete beneath the ledge 20. This reduction in labor and material placement makes the installation process more efficient and cost effective.

Fiberglass shells 15 with the structural assembly 70 provide the following benefits to the installer:

1. eliminates or reduces the material and labor cost to attempt to pack stone into the void beneath the tanning ledge;
2. eliminates or reduces the material and labor cost associated with installing flowable concrete beneath the ledge;
3. reduces shell installation time by hours/days;
4. provides integrated channels to run plumbing for water features beneath the ledge; and
5. simplifies the shell leveling process.

Fiberglass shells 15 with the undercarriage assembly 70 provide the following benefits to the pool owner:

1. a ledge that feels solid under foot;
2. a ledge floor that is flat without voids or humps;
3. a pool vessel that is level; and
4. faster installation time which allows the pool owner to swim sooner.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A swimming pool assembly, comprising:

a swimming pool body defining a pool top edge and an oppositely disposed bottom pool floor member connected by at least one pool wall and having a shallow deck portion;

a support structure for providing support to the deck portion operationally connected to the deck portion and extending away from the pool top edge, wherein the support structure further comprises:

a plurality of spaced elongated beam members;

a support member operationally connected to the deck portion and to the plurality of spaced elongated beam members, wherein the respective spaced elongated beam members are positioned opposite the deck portion;

at least one support structure wall member operationally connected to the plurality of spaced elongated beam members; and at least one pipeline operationally connected to the at least one support structure wall member and in hydraulic communication with at least one trough.

2. The assembly of claim 1 wherein the support structure is positioned in an excavation and wherein the respective beams are positioned to rest on backfill.

3. The assembly of claim 1 wherein the respective beams have rectangular cross-sectionals.

4. The assembly of claim 1 and further comprising a pump operationally connected to the at least one pipeline.

5. The assembly of claim 1 wherein the support structure is formed unitarily as part of the swimming pool body.

6. The assembly of claim 1 wherein the support structure is adhered to the swimming pool body.

7. The assembly of claim 6 wherein the support structure is fusion bonded to the swimming pool body.

8. A kit for modifying a preformed swimming pool having a tanning ledge, comprising:

a support structure for engaging a swimming pool tanning ledge and an oppositely disposed backfilled excavation, wherein the support structure is permanently connectable to the tanning ledge for providing support to the tanning ledge and having a plurality of spaced elongated support members connected thereto for engaging backfill disposed opposite the tanning ledge and wherein the plurality of spaced elongated support members define a plurality of recessed troughs therebetween; and a supply of adhesive for permanently bonding the support structure to the tanning ledge.

9. The kit of claim 7 wherein the support structure is fiberglass and wherein the adhesive is fiberglass bonding agent.

10. A method of stabilizing a preformed swimming pool body having a tanning ledge, comprising:

a) engaging a plurality of spaced elongated support members below a tanning ledge of a preformed fiberglass swimming pool body to define a swimming pool assembly;

b) positioning the swimming pool assembly in an excavation; and c) supporting the tanning ledge with the backfill engaging respective spaced elongated support members extending into the excavation.

11. The method of claim 10 and further comprising:

d) pumping water into the pool body.

* * * * *